US009549574B1

(12) United States Patent
Squire

(10) Patent No.: US 9,549,574 B1
(45) Date of Patent: Jan. 24, 2017

(54) HALO SHIRT

(71) Applicant: Rhoda Squire, South Daytona, FL (US)

(72) Inventor: Rhoda Squire, South Daytona, FL (US)

( * ) Notice: Subject to any disclaimer, the term of this patent is extended or adjusted under 35 U.S.C. 154(b) by 513 days.

(21) Appl. No.: 14/081,129

(22) Filed: Nov. 15, 2013

(51) Int. Cl.
*A41B 1/10* (2006.01)

(52) U.S. Cl.
CPC ..... *A41B 1/10* (2013.01)

(58) Field of Classification Search
CPC ..... A41B 1/00; A41B 1/18; A41B 3/06; A41B 3/02; A41B 9/06; A41B 13/1236; A41B 13/1245; A41B 13/1281
See application file for complete search history.

(56) References Cited

U.S. PATENT DOCUMENTS

| | | | | | |
|---|---|---|---|---|---|
| 818,351 | A | | 4/1906 | Clark | |
| 1,462,515 | A | | 7/1923 | McElroy | |
| 3,137,860 | A | * | 6/1964 | Bindler | A41D 27/10 2/115 |
| 4,382,303 | A | | 5/1983 | Lunt | |
| 4,384,371 | A | * | 5/1983 | Sonne | A42B 1/206 2/104 |
| 4,567,611 | A | | 2/1986 | Kendrick | |
| 4,710,979 | A | * | 12/1987 | Bull | A41B 13/10 2/48 |
| 4,920,578 | A | | 5/1990 | Janzen | |
| 5,131,096 | A | | 7/1992 | Olson | |
| 5,564,123 | A | | 10/1996 | Grassick | |
| D396,339 | S | | 7/1998 | Ramsey | |
| 5,799,330 | A | | 9/1998 | O'Donoghue-Kitt | |
| 6,115,840 | A | | 9/2000 | Hastings | |
| 6,282,720 | B1 | * | 9/2001 | Mayer | A41B 9/06 2/113 |
| 6,378,136 | B2 | | 4/2002 | Matsushita | |
| D635,335 | S | | 4/2011 | Eckman | |
| 2011/0271420 | A1 | * | 11/2011 | Lawrence | A41B 9/06 2/113 |

* cited by examiner

*Primary Examiner* — Shaun R Hurley
*Assistant Examiner* — Andrew W Sutton
(74) *Attorney, Agent, or Firm* — Brian S. Steinberger; Law Offices of Brian S. Steinberger, P.A.

(57) ABSTRACT

Apparel, clothing and methods of using clothing tops with a wider front and rear necklines for patients wearing halo braces. The wider necklines and adjustable ties with slit opening allow the clothing top to be worn and removed without the patient being in pain while the brace is attached to the patient's head and body. It makes the patient look presentable as well as comfortable. It will allow individuals both men and women to be well dressed for physical therapy and any other outings.

12 Claims, 3 Drawing Sheets

HALO SHIRT

FIELD OF INVENTION

This invention relates to apparel, and in particular to apparel, clothing and methods of using adjustable shirts and clothing tops with adjustable rear necklines to provide room for patients wearing halo braces in severe pain needing to look decent for physical therapy.

BACKGROUND AND PRIOR ART

Halo braces are commonly used after a neck fracture or dislocation. A halo brace is a metal brace that circles and attaches to a patient's skull and are used to keep the bones in the cervical spine (neck) from moving. Pins screwed into the skin above the eyebrows keep the halo in place. Metal rods generally connect the halo to a plastic type vest worn over the user's chest and back. Halo braces are often used after a neck fracture or dislocation. A problem occurs when the patient is using halo brace and has to go to therapy, and they have no clothing except a hospital gown because of the halo brace attached to their head Regular shirts have necklines that are too small for the person with the halo brace on. The necklines do not fit, and the patients need more room to get their hands into the sleeve of the shirt since they are in pain and cannot put their hands into the sleeve of the shirt due to the width and height of the halo brace making it difficult for the patient.

Thus, the need exists for solutions to the above problems with the prior art.

SUMMARY OF THE INVENTION

A primary objective of the present invention is to provide apparel with adjustable necklines for patients wearing halo braces that allows for ease in putting on shirts and clothing tops while the halo brace is attached to the patient.

A secondary objective of the present invention is to provide apparel and clothing for patients wearing a halo brace to be decently dressed for physical therapy.

The inventor created the invention when there was a complaint from the therapist for not always having appropriate clothing for patients wearing halo braces In order to have more room, the subject invention with slit back of the shirt was created, to make it easier for the patient to wear the shirt without pain.

A clothing top such as a shirt can include a front section having a left panel completely detachable from a right panel, a plurality of first fasteners for attaching the left panel to the right panel, the front section adapted to cover an upper front torso of a patient wearing a halo device, a rear panel having closed sides which attach to side edges of the front section, the rear panel having a closed bottom, a slit opening running from an upper neckline of the rear panel downward and ending before the closed bottom, and second fasteners for adjusting the slit opening between closed and open, the rear panel adapted to cover an upper rear torso of a patient wearing the halo device.

The plurality of first fasteners can include buttons and corresponding button holes, which allow the left panel to be detachable from the right panel.

The second fasteners can include a pair of pull ties that pass through a piping in the slit opening, the pull ties being capable of being tied together in order to adjust the opening and closing of the slit opening.

The clothing top can include sleeves extending from upper left and upper right sides of the front section and the rear panel.

The front section can include a concave curved front neckline.

The rear panel can include a rear neckline, wherein the front neckline drops below the rear neckline. The rear neckline can include a flat lower line and angled ends.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Clothing top such as a shirt.
20 Front panel of clothing top.
30 Sleeve.
40 Left front panel of clothing top.
50 Button.
60 Front neckline.

70 Rear neckline.
80 Tie piping on rear opening.
90 Rear opening (approximately 7.5 inches long.
100 Rear back of shirt.
110 Button hole on front panel.
120 Patient wearing halo device.
130 Halo device.
140 Vest of halo device.
150 Support strut of halo Device.

Figure 2:
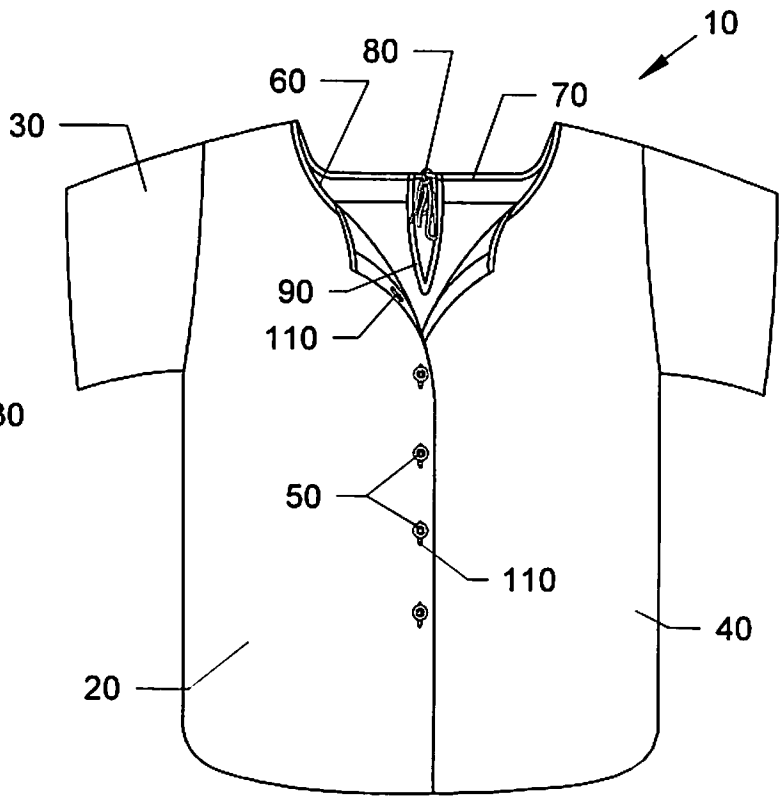
FIG. 2 is another front view of the novel shirt with button open.
Figure 1:
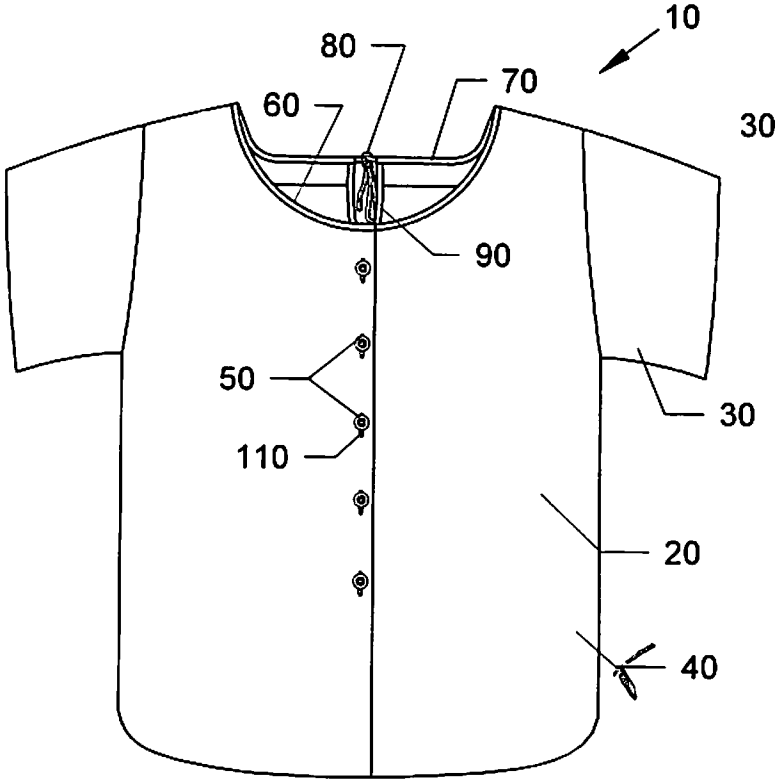
FIG. 1 is a front view of the novel shirt with button closed.

FIG. 1 is a front view of the novel shirt 10 with buttons closed. FIG. 2 is another front view of the novel shirt 10 with buttons, front opened at neck.

Referring to FIGS. 1-2, the novel shirt 10 can have a front 40 with two panels 20, and sleeves extending therefrom. The front panels 20 can be joined together by buttons 50 that pass through button holes 110, so that the front 40 of the shirt 10 can be separated in half.

Figure 4:
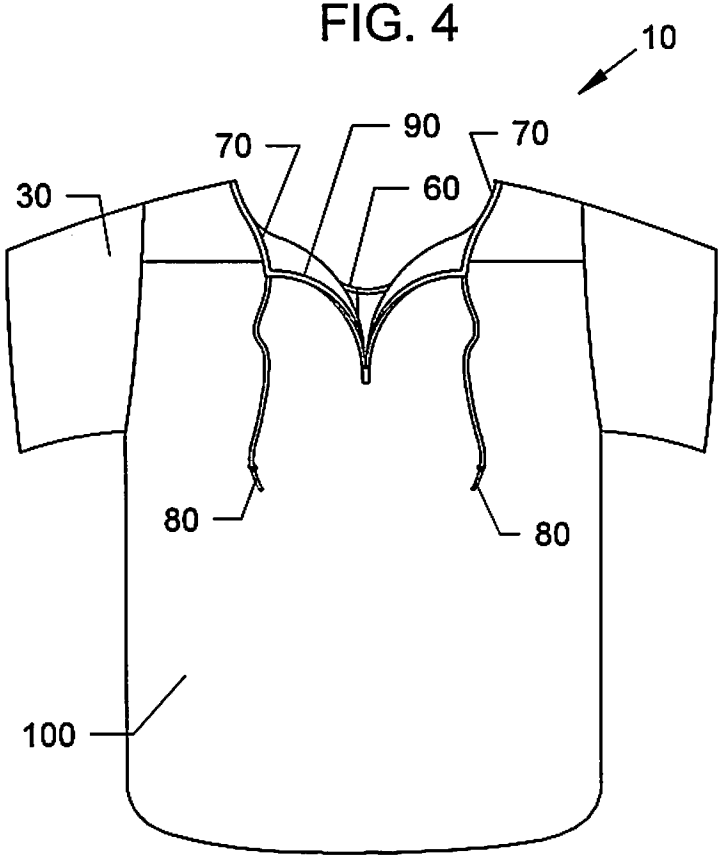
FIG. 4 is another rear view of the novel shirt of FIG. 3 with slit at back and ties opened.
Figure 3:
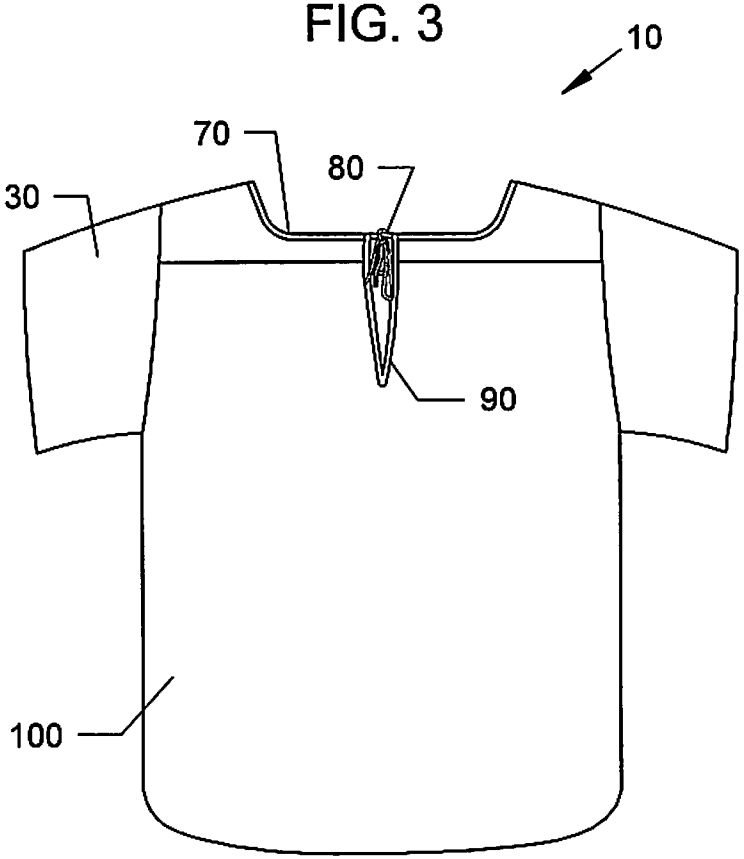
FIG. 3 is a rear view of the novel shirt of FIG. 1 with slit at back with ties tied.

FIG. 3 is a rear view of the novel shirt 10 of FIG. 1 with tie closed. FIG. 4 is another rear view of the novel shirt 10 of FIG. 3 with back slit opened.

Referring to FIGS. 1-4, the back 100 of the shirt 10 can be a generally single panel with sides connected to outer sides of the front 40 of the shirt 10, with the upper corners being attached to sleeves 30. The rear neckline 70 can have angled ends and a flat midportion that is generally higher than the front neckline 60.

Midway between the piping portion of the rear neckline 70 can be generally a slit (or opening) 90, with opposite portions of the upper part of the opening having ties 80 coming out of the piping 90 that can be adjusted or tied depending on who is wearing it.

The novel shirt 10 can be manufactured in various colors and sizes. It can be produced easily using conventional available materials like cotton and polyester.

Figure 5:
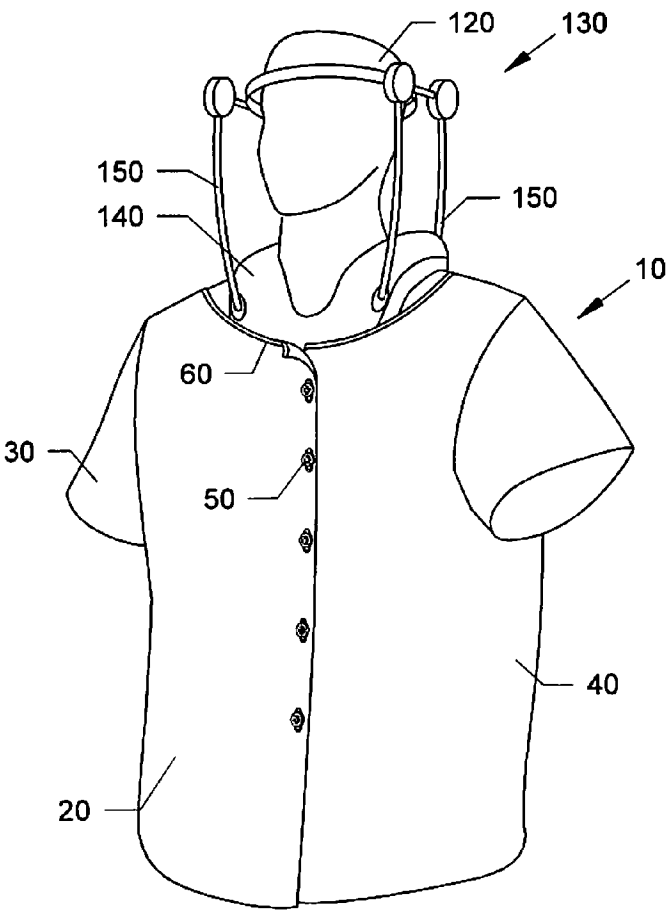
FIG. 5 is a front perspective view of a patient having a halo device wearing the novel shirt with a wider neckline of FIGS. 1-2.

FIG. 5 is a front perspective view of a patient 120 having a halo device 130 that can include a vest 140 and support strut 150, with the patient 120 wearing the novel shirt 10 of FIGS. 1-2.

Figure 6:
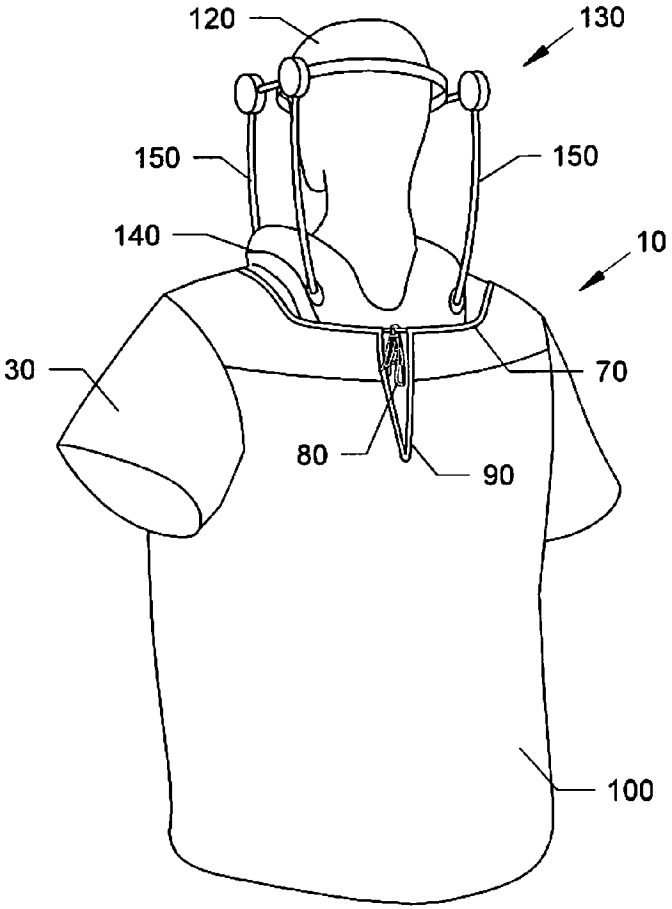
FIG. 6 is a rear perspective view of the patient having the halo device shown in FIG. 5 wearing the novel shirt.

FIG. 6 is a rear perspective view of the patient 120 having the halo device 130 with vest 140 and support strut 150 shown in FIG. 5 with the patient 120 wearing the novel shirt 10.

Referring to FIGS. 1-6, the patient 120 having the halo device 130 with vest 140 and support strut 150, can easily take off the novel shirt 10 by unbuttoning the buttons 50 and button holes 110 on the front 40 of the shirt 10, and untying the ties 80 on the rear 100 of the shirt.

Similarly, the shirt 10 can be placed on the patient 120 having the halo device 130 with vest 140 and support strut 150 by inserting the patient's arms into the sleeves 30 while the front buttons 40 are detached from the front button holes 110 and the rear opening/slit 90 is loose and the ties 80 detached from one another. After placing the shirt 10 on the patient 120, the button holes 110 can be buttoned to corresponding button holes 110 and ties 80 can be pulled together and tied with each other to close off the slit/opening 90.

In a preferred embodiment, the back slit opening can be approximately 7.5 inches. An overall neckline can be approximately 38 inches. The front neckline can be approximately 12.5 inches on each half (approximately 25 inches total), and the back neckline can be approximately 6.5 inches on each half (approximately 13 inches total). The term approximately can include +/−10%.

While the novel clothing is shown as a shirt, other types of upper clothing can be used, such as but not limited to jackets, sweaters, and the like.

Although the novel shirt is shown with short sleeves, the shirt can have long sleeves. Alternatively, the shirt can be a vest.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A halo shirt, comprising:

a front section having a left panel completely detachable from a right panel, the left panel and the right panel each consisting of a solid contiguous material, the front section having a front neckline consisting of a continuous concave curve running between the left panel and the right panel, the front section consisting of a single break line running from a middle of the continuous concave curve front neckline to a bottom of the front section;

a plurality of first fasteners for attaching the left panel to the right panel, the front section adapted to cover an upper front torso of a patient wearing a halo device;

a rear panel having closed sides which attach to side edges of the front section, the rear panel having a closed bottom, the rear panel having rear neckline consisting of a flat middle elongated section with opposite ends sloping upward and extending outward from the flat middle elongated section, the flat middle elongated section of the rear neckline being higher than a middle of the continuous concave curve front neckline, the rear panel consisting of a single break line, the single break line consisting of a single slit opening running from a middle of the flat middle elongated section of the rear neckline of the rear panel downward and ending substantially before the closed bottom; and second fasteners for adjusting the slit opening between closed and open, the rear panel adapted to cover an upper rear torso of a patient wearing the halo device.

2. The halo shirt of claim 1, wherein the plurality of first fasteners includes:

buttons and corresponding button holes, which allow the left panel to be detachable from the right panel.

3. The halo shirt of claim 2, wherein the second fasteners include: a pair of pull ties that pass through a piping in the slit opening, the pull ties being capable of being tied together in order to adjust the opening and closing of the slit opening.

4. The halo shirt of claim 1, further comprising:

sleeves extending from upper left and upper right sides of the front section and the rear panel.

5. A halo clothing top, comprising:

a front section having a left panel completely detachable from a right panel, the left panel and the right panel each consisting of a solid contiguous material, the front section having a front neckline consisting of a continuous concave curve running between the left panel and the right panel, the front section consisting of a single break line running from a middle of the continuous concave curve front neckline to a bottom of the front section;

a plurality of first fasteners for attaching the left panel to the right panel;

a single rear panel having closed sides which attach to side edges of the front section, the rear panel having a closed bottom the rear panel having rear neckline consisting of a flat middle elongated section with opposite ends sloping upward and extending outward from the flat middle elongated section, the flat middle elongated section of the rear neckline being higher than a middle of the continuous concave curve front neckline, the rear panel consisting of a single break line, the single break line consisting of a single slit opening running from a middle of the flat middle elongated section of the rear neckline of the rear panel downward and ending substantially before the closed bottom; and second fasteners for adjusting the slit opening between closed and open, the front section and the rear panel forming a clothing top adapted to cover both an upper front torso and an upper rear torso of a patient wearing a halo device.

6. The halo clothing top of claim 5, wherein the plurality of first fasteners includes:

buttons and corresponding button holes, which allow the left panel to be detachable from the right panel.

7. The halo clothing top of claim 6, wherein the second fasteners include: a pair of pull ties that pass through a piping in the slit opening, the pull ties being capable of being tied together in order to adjust the opening and closing of the slit opening.

8. The halo clothing top of claim 5, further comprising:

sleeves extending from upper left and upper right sides of the front section and the rear panel.

9. The halo shirt of claim 1, wherein the single slit opening in the rear panel is approximately 7.5 inches long.

10. The halo shirt of claim 9 wherein the front neckline has an overall length of approximately 25 inches, and the rear neckline has an overall length of approximately 13 inches.

11. The halo clothing top of claim 5, wherein the single slit opening in the rear panel is approximately 7.5 inches long.

12. The halo clothing top of claim 11, wherein the front neckline has an overall length of approximately 25 inches, and the rear neckline has an overall length of approximately 13 inches.

* * * * *